United States Patent [19]

Padilla, Sr.

[11] 4,421,062

[45] Dec. 20, 1983

[54] WELL GAS POWERED WELL EFFLUENT HEAT TREATING SYSTEM

[76] Inventor: Isaac F. Padilla, Sr., 4910 S.S. River Rd., Farmington, N. Mex. 87401

[21] Appl. No.: 435,885

[22] Filed: Oct. 21, 1982

[51] Int. Cl.[3] ..... F27B 33/18

[52] U.S. Cl. ..... 122/1 R; 122/32; 122/367 R; 237/19

[58] Field of Search ..... 122/32, 1 R, 33, 367 R, 122/34; 166/62; 237/13, 19, 61

[56] References Cited

U.S. PATENT DOCUMENTS

| | | | |
|---|---|---|---|
| 4,037,779 | 7/1977 | Roy et al. | 237/61 |
| 4,037,786 | 7/1977 | Munroe | 237/19 |
| 4,136,731 | 1/1979 | DeBoer | 237/19 |
| 4,222,350 | 9/1980 | Pompei et al. | 122/33 |
| 4,352,341 | 10/1982 | Styslinger | 122/32 |

*Primary Examiner*—Henry C. Yuen

*Attorney, Agent, or Firm*—Harvey B. Jacobson

[57] ABSTRACT

A heating chamber is provided for receiving well effluent therein including oil, water and gas and a heated chamber is also provided for containing a heat exchange liquid to be heated. Liquid heat exchange coils are disposed in the chambers and are serially connected in a closed loop flow path with gas pressure operated pump structure operatively associated with the closed loop flow path for pumping liquid therethrough. Gas fired heating structure is operatively associated with the heated chamber for heating liquid therein and a gas outlet from the heating chamber comprises a source of well gas under pressure directed through supply structure supplying well gas to the pump and burner structures. The supply structure includes a gas flow line, in which the pump structure is serially disposed, extending from the gas source to the pump structure and thereafter to the burner structure. The gas flow line includes a thermostatically controlled flow valve therein for opening and closing the flow line responsive to predetermined low and high temperatures in the heating chamber and a gas pressure operated control valve is connected in the gas flow line between the burner and the pump under the control of a self venting thermostat responsive to the temperature of the heated chamber and disposed in a gas supply line communicated with the gas outlet at its inlet end and with the gas pressure operated control valve at its outlet end.

11 Claims, 9 Drawing Figures

WELL GAS POWERED WELL EFFLUENT HEAT TREATING SYSTEM

BACKGROUND OF THE INVENTION

Well effluent including oil, water and gas is conventionally treated with heat in order to separate the water from the oil and to prevent solidification of liquid components of the effluent. In order to accomplish the desired heat treatment of well effluent the latter is received in a separator in which gas may readily separate from the oil and water components of the effluent and the oil and water components of the effluent may be heated in order to drive the water from the oil.

Various types of separators and heating structures for state of the art separators heretofor have been provided. However, many previously known heating structures are not of the type wherein well gas may be used as a power source to drive pump structure for pumping heat transfer liquid and thereafter used as a source of fuel for a burner. Accordingly, a need exist to provide a heat treating system which may not only utilize well gas under pressure for powering a heat transfer liquid circulating pump but which may subsequently also be used as fuel for a gas burner and pilot. In this manner, gas fuel consumption is maintained at a minimum.

Examples of well effluent heat treating systems utilizing some of the general structural and operational features of the instant invention are disclosed in U.S. Pat. Nos. 2,601,903, 2,657,760, 2,726,729, 2,758,665, 2,765,045 and 3,318,071.

BRIEF DESCRIPTION OF THE INVENTION

The well effluent heat treating system of the instant invention incorporates a pair of closed chambers each having a heat transfer coil disposed therein and with the heat transfer coils disposed in a closed loop circuit equipped with pump means for pumping heat transfer fluid through the loop circuit. A first of the chambers has a heat transfer liquid therein and the second chamber has well effluent including gas, oil and water pumped thereinto for heat treatment. A gas fired burner is provided for heating the heat transfer liquid in the first chamber and the pump means is constructed to be driven as a result of gas under pressure being supplied thereto. A thermostat sensing the temperature of the well effluent in the second chamber controls the flow of motive gas to the pump means and a thermostat sensing the temperature of the heat transfer liquid within the first chamber is operative to control the flow of gas to the gas fired burner. The closed loop circuit and the heat transfer coils have a heat exchange fluid therein and by heating the heat transfer liquid within the first chamber to a temperature above and below predetermined minimum and maximum temperatures and pumping the heat exchange fluid through the loop circuit and the heat transfer coils upon thermostat demand sensing the temperature of the well effluent in the second chamber, precise heating of the well effluent in the second chamber may be maintained. Further, by providing a gas pressure powered pump means and a gas fired burner, the entire well effluent heat treating system may be operated at a low cost independent of contamination of the heat transfer liquid within the first chamber. The volume of heat transfer liquid within the first chamber may considerably exceed the volume of the heat exchange fluid in the closed loop circuit and the volume of well effluent in the second chamber may also considerably exceed the closed loop circuit volume. Only the heat exchange fluid is subject to contamination, but the degree of contamination of the heat exchange fluid is maintained at a minimum inasmuch as the only contamination thereof may be by the well gas utilized to power the pump means and this well gas may comprise a substantially pure by-product of the operation of the well effluent heat treating system.

The main object of this invention is to provide a well effluent heat treating system which may substantially continuously operate in a well effluent heat treating mode independent of moving mechanical components other than thermostatically controlled valves and manual and automatic operating valves.

Another object of this invention is to provide a well effluent heat treating system operative to utilize a gas pressure operated pump for effecting circulation of a heat exchange fluid and including structure whereby the gas exhausted from the pump is reclaimed and used as fuel for both the gas fired burner and the burner pilot.

A final object of this invention to be specifically enumerated herein is to provide a well effluent heat treating system in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
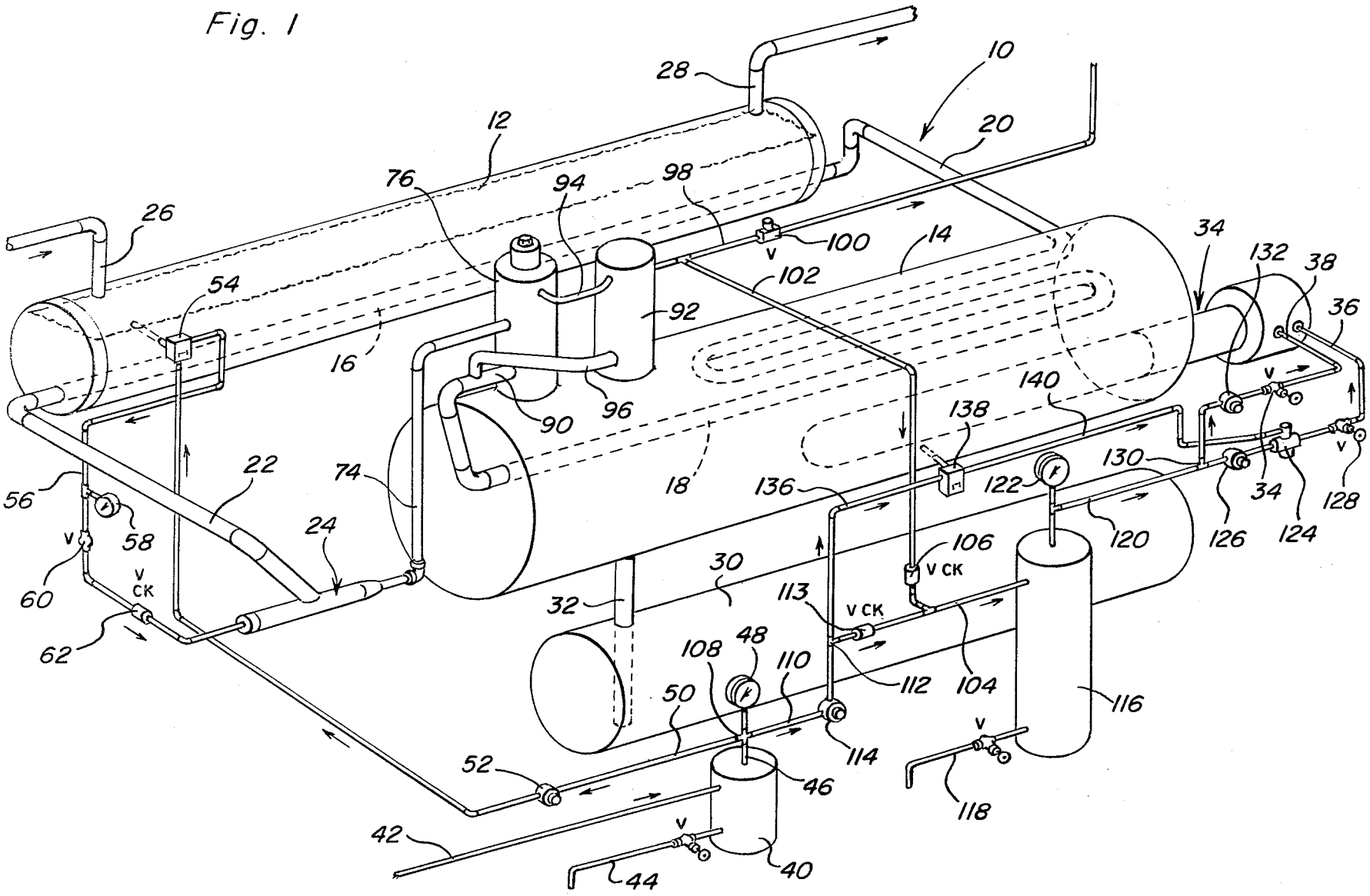
FIG. 1 is a schematic view of the well effluent heat treating system of the instant invention.
Figure 2:
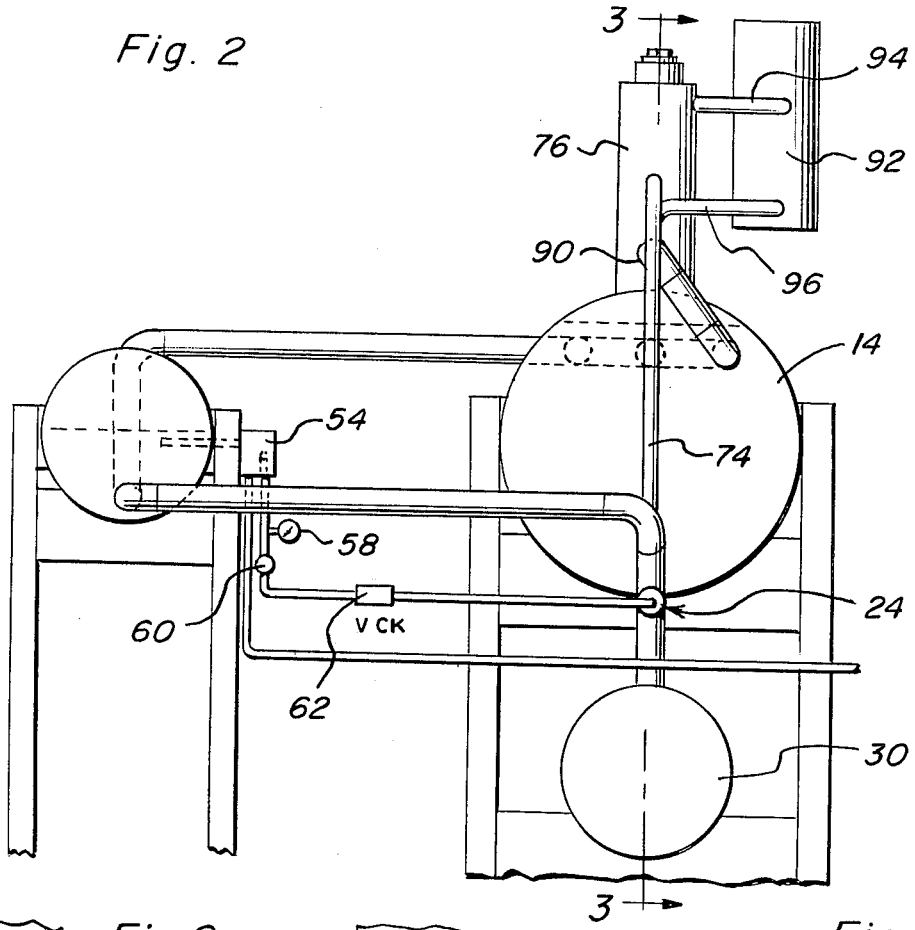
FIG. 2 is a fragmentary elevational view of the heat treating system as seen from the left side of FIG. 1.

Referring now more specifically to the drawings the numeral 10 generally designates the well effluent heat treating system of the instant invention. The system 10 includes a first well effluent heating or separator tank 12, a second heated or reboiler tank 14, a pair of heat exchange coils or pipes 16 and 18 in the tanks 12 and 14 and connecting pipes 20 and 22 communicating the pipes 16 and 18. The pipes or coils 14 and 16 and the pipes 20 and 22 define a closed loop circuit in which there is disposed a gas jet pump for pumping a heat transfer liquid such as tri-ethylene glycol through the closed loop.

The tank 12 includes a well effluent inlet 26 and a gas outlet 28 as well as a liquid outlet (not shown) under the control of a float-type dump valve. The tank 14 is communicated with a storage tank 30 disposed therebelow by a pipe 32 and the tank 14 and tank 30 have a heat transfer liquid of any suitable type such as tri-ethylene glycol disposed therein. The tank 14 further includes a gas fired burner referred to in general by the reference numeral 34 operatively associated therewith and the burner 34 includes burner and pilot gas supply lines 36 and 38.

An initial drip pot 40 is provided for receiving a supply of well gas under pressure through a supply line 42 opening into the drip pot 40 at its discharge end. The gas supply line 42 receives its supply of gas from the outlet 28, but the gas supplied to the line 42 may be dried or otherwise treated. The drip pot 40 includes a valved drain line 44 and an outlet line 46 having a pressure gauge 48 communicated therewith and opening into a line 50 having a pressure regulator 52 serially connected therein. The gas is supplied to the drip pot 40 through the line 42 at a pressure between 25 psi and 100 psi and the regulator 52 limits the pressure of the gas in the line 50 downstream from the regulator to 25 psi. The line 50 extends to a thermostat controlled valve 54 which senses the temperature of the well effluent in the tank 12 and a line 56 extends from the thermostat 54 to the pump 24 and has a manual valve 60 and a check valve 62 serially disposed therein, the check valve 62 being disposed downstream from the valve 60.

The outlet end of the line 56 includes a discharge tube 64 which opens longitudinally into the housing 66 of the pump 24 through an adjustable friction seal 68 and the tube 64 may be shifted longitudinally of the housing 66 through the seal 68 as desired. The pipe 22 opens into the cylindrical elongated housing 66 of the pump 24 at approximately a 45° angle centrally intermediate the opposite ends of the housing 66 and the end of the housing 66 remote from the seal 68 tapers downwardly to a diametrically reduced end portion 70 opening into and sealed relative to an elbow fitting 72 from which the lower end of a lift pipe 74 is supported, the upper end of the lift pipe 74 opening into an upstanding separator chamber 76. The diametrically reduced end portion 70 of the housing 66 includes an eductor tube 78 extending longitudinally therethrough and equipped with a funnel shaped inlet end which projects upstream into the central portion of the housing 66. When gas under pressure of approximately 25 psi is discharged from the tube 64 into the eductor tube 78, a venturi effect is provided drawing the heat transfer liquid from the housing 66 upstream from the eductor tube 78 into the latter. Thus, the heat transfer liquid is drawn into the housing 66 from the pipe 22. As the gas and heat transfer liquid is discharged from the downstream end of the eductor tube 78, an additional venturi effect is formed immediately outwardly of the eductor tube discharge end and additional heat transfer liquid is drawn through the end portion 70 of the housing 66 between the interior walls of the end portion 70 and the exterior walls of the eductor tube 78. The heat transfer liquid and gas rise upwardly through the lift pipe 74 and enter the separator chamber 76 supported from the tank 14.

The separator chamber 76 includes a central downflow tube 82 therein which terminates downwardly a spaced distance above the bottom of the tank 14 and thereby defines an annular upflow passage 84 disposed about the downflow tube 82. The upper end of the downflow tube 82 is secured centrally through a circular baffle 86 mounted within the separator chamber 76 and the upper portion of the upflow passage 84 includes an outlet tube 90 through which the heat transfer liquid may be discharged from the separator chamber 76 into the heat exchange coil 18. A scrubber housing 92 is supported from the tank 14 alongside the separator chamber 76 and an upper gas line 94 communicates the upper portion of the interior of the separator chamber 76 with the upper portion of the interior of the scrubber housing 92. The housing 92 discharges through a outlet tube 96 which opens into the outlet tube 90.

The scrubber housing 92 includes a gas outlet line 98 opening outwardly therefrom having a relief valve 100 serially connected therein and set at approximately 23 psi. The outlet line 98 may have its discharge end vented to the atmosphere. However, a gas line 102 extends from the line 98 intermediate the scrubber housing 92 and the relief valve 100 and opens into a supply line 104 centrally intermediate its opposite ends, the line 102 including a check valve 106 therein. The line 104 is communicated with the line 110 by a T-fitting 112 and has a check valve 113 therein. The line 110 includes a regulator 114 therein which is set to approximately 5 psi and the discharge end of the supply line 104 opens into a drip pot 116 including a manual valve controlled drain line 118. A line 120 opens outwardly of the upper end of the drip pot 116 and has a pressure gauge 122 operatively associated therewith and the line 120 has a diaphragm-type motor valve 124 disposed therein. In addition, the line 120 includes a regulator 126 disposed therein intermediate the drip pot 116 and the motor valve 124, the regulator 126 being set to 2–5 psi. The line 120 includes a manual valve 128 downstream from the motor valve 124 and its outlet end comprises the burner gas supply line. In addition, the pilot gas supply line opens into the line 120 at a T-fitting 130 and has a regulator 132 disposed therein corresponding to the regulator 126 as well as a manual valve 134 serially connected therein corresponding the valve 128.

A gas line 136 extends from the T-fitting 112 to a thermostat controlled valve 138 which senses the temperature of the heat transfer liquid within the tank 114 and a line 140 extends from the valve 138 to the motor valve 124.

Assuming that the system 10 is at operating temperature, when heat is required for additional heating of the well effluent in the tank 12, the need for heat is sensed by the thermostat valve 54 and gas flows from the line 50 into the line 56 and thereby through the pump 24 to cause heat transfer liquid to circulate through the heat exchange coils 16 and 18 and the pipes 20 and 22. With the temperature of the heat transfer liquid within the tank 14 at a level above the desired temperature of the well effluent in the tank 12, the flow of heat transfer liquid through the heat exchange coils 16 and 18 and the pipes 20 and 22 provides the necessary additional heat within the tank 12 for heating the well effluent therein. However, when the heat of the heat transfer liquid within the tank 14 drops to a predetermined minimum, this is sensed by the thermostat valve 138 which then allows gas to flow through the line 136 and 140 to the diaphragm within the motor valve 124 opening the latter and allowing burner gas to flow through the lines 110, 104, 120 and 36 for operation of the burner 34. Inasmuch as the line 102 communicates the lines 98 and 104 it may be seen that gas sufficient for operation of the pilot associated with the burner 34 is always available. Thus, the gas utilized to operate the pump 24 is finally discharged from the liquid scrubber and used not only as a source of gas for the burner pilot but also as a source of gas for the burner itself. Further, the tanks 12 and 14, the pipes 20 and 22, the pump 24, the lift pipe 74 and the tubes or pipes 90 and 96 may all be insulated and according to the ambient temperature and the desired speed of operation of the system 10, the longitudinal positioning of the discharge tube 64 may be adjusted in order that it is necessary to vent only a minimum amount of gas from the outlet end of the line 98. Further, the heat transfer liquid within the coils 16 and 18 and the pipes 20 and 22 is maintained separate from the heat transfer liquid within the tanks 14 and 30 thereby preventing any contamination of the heat transfer liquid within the tanks 14 and 30. Also, by installing the relief valve 100 in the gas outlet line 98 downstream from the line 102 and with the relief valve set at 23 psi, gas will flow through the orafice of the gas pump 24 as long as the separator tank 12 requires heat. In addition, by setting the pressure to the thermostat valve at the separator tank 12 at 25 psi and using a large volume separator chamber or drip pot 116, gas will flow through the pump orifice until the pressure within the drip pot 116 equalizes with the pressure to the pump jet orifice.

Figure 6:
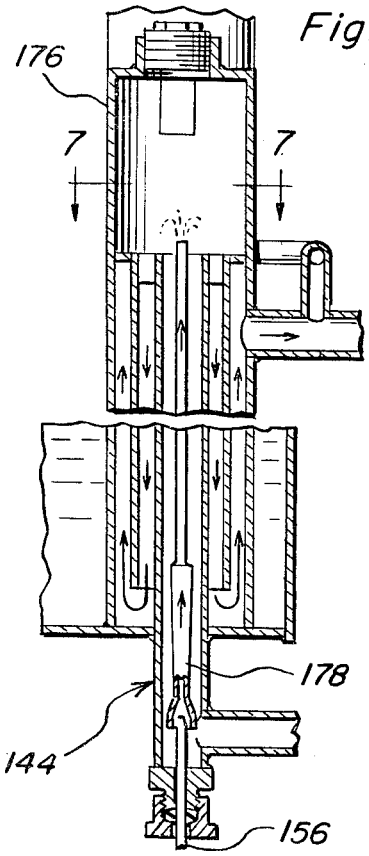
FIG. 6 is an enlarged fragmentary vertical sectional view illustrating a modified form of heat treating system utilizing a vertically disposed gas jet pump.
Figure 8:
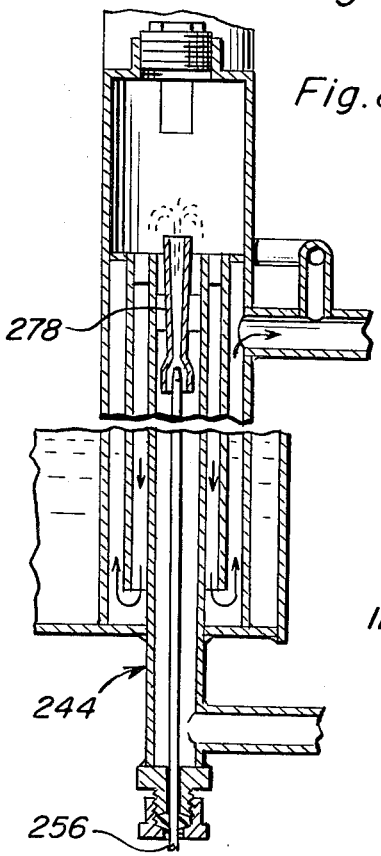
FIG. 8 is a fragmentary enlarged vertical sectional view similar to FIG. 6 but illustrating a second modified form of heat treating system utilizing a vertical gas jet pump.
Figure 7:
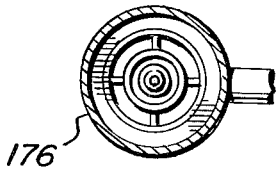
FIG. 7 is a horizontal sectional view taken substantially upon the plane indicated by the section line 7—7 of FIG. 6.

With attention now invited more specifically to FIG. 6 of the drawings, it may be seen that the horizontal gas jet pump 24 may be substituted for by a vertical gas jet pump 144 to which gas under pressure may be supplied from the thermostat valve 54 through a gas line 156 corresponding to the gas line 56. In this instance, the pump 144 opens directly into a separator chamber 176 corresponding to the separator chamber 76. In addition, the pump 144 may utilize an eductor tube 178 corresponding the eductor tube 78 at the lower end of the pump 144, or a modified form of vertical pump 244 may be used including an eductor tube 278 at the upper end thereof. Of course, the discharge end of the line 156 is vertically adjustable relative to the eductor tube 178 and the discharge end of the line 256 to be used in conjunction with the pump 244 is also vertically adjustable relative to the corresponding eductor tube 278.

Figure 9:
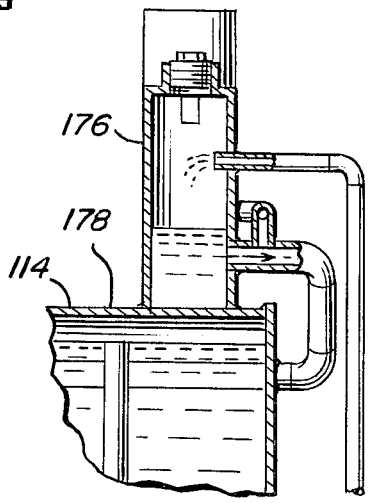
FIG. 9 is a fragmentary vertical sectional view illustrating the interior of the gas and liquid separator utilized in conjunction with the horizontal gas jet pump.
Figure 3:
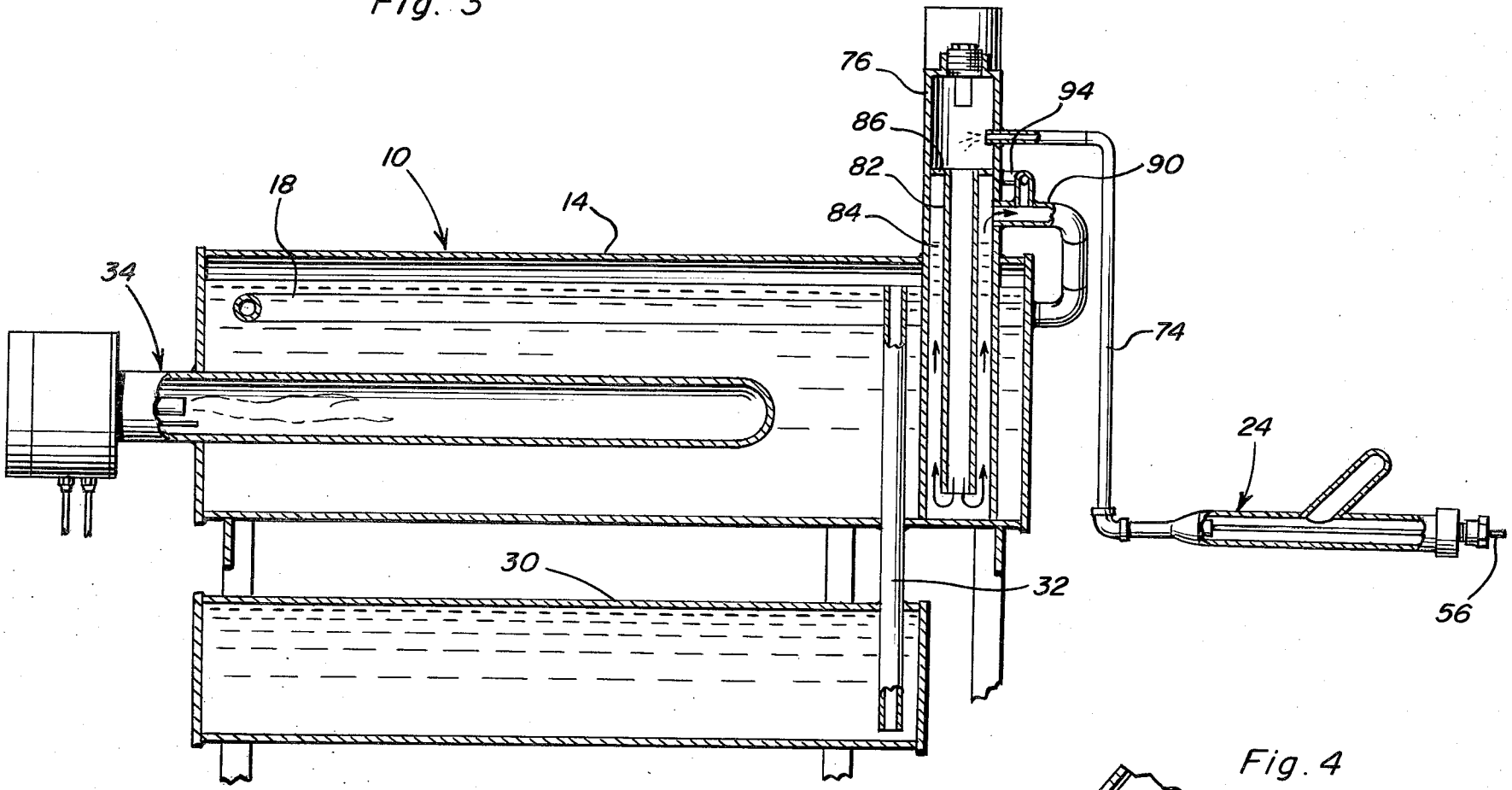
FIG. 3 is a fragmentary enlarge vertical sectional view taken substantially upon the plane indicated by the section line 3—3 of FIG. 2.
Figure 4:
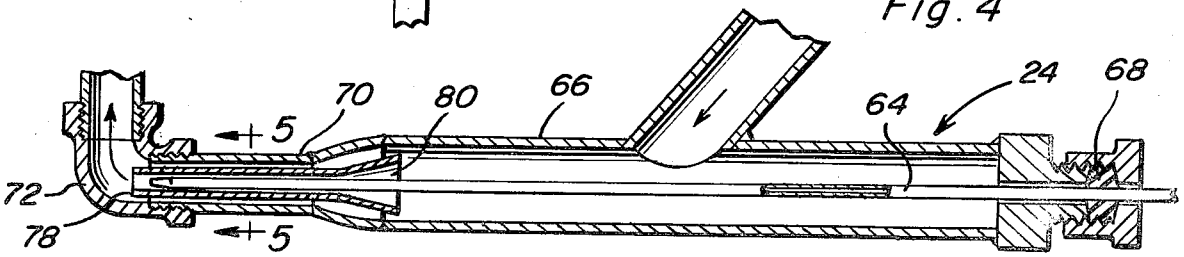
FIG. 4 is an enlarged fragmentary vertical sectional view of the horizontal gas jet pump illustrated in the right hand portion of FIG. 3.
Figure 5:
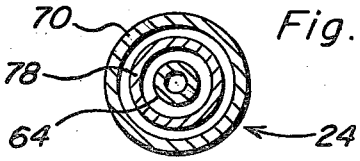
FIG. 5 is an enlarged vertical sectional view taken substantially upon the plane indicated by the section line 5—5 of FIG. 4.

Also, if it is desired, the separator chamber utilized in conjunction with the pump 24 may be constructed in the simplified manner illustrated at 176 in FIG. 9. The separator chamber 176 merely is secured and sealed relative to the upper wall 178 of the tank 14 and does not include the downflow tube 82 or the partition or baffle 86.

Whether the system 10 utilizes the pump 24, the pump 144 or the pump 244, the operation of the system 10 remains substantially the same.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A well effluent heat treating system including a heating chamber for receiving well effluent therein including oil, water and gas, a heated chamber containing a liquid to be heated, liquid heat exchange coils in said chambers serially connected in a closed loop liquid flow path, heating means for heating the liquid in said heated chamber, pump means for pumping liquid through said closed loop flow path, said heating chamber including a gas outlet, said heating means including gas burner means in good heat transfer relation with said liquid in said heated chamber, a source of well gas under pressure, said pump means comprising gas pressure operated pump means, supply means for supplying well gas from said source to said pump means and burner means, said supply means including a gas flow line extending from said source to said pump means and subsequently to said burner means, and including a first thermostat controlled flow valve being operable to open and close said first control valve responsive to predetermined low and high temperatures in said heating chamber and a second thermostat controlled flow valve operable to open and close said second control valve responsive to predetermined low and high temperatures in said heated chamber.

2. The system of claim 1 wherein said first and second thermostat controlled flow valves include means for operation under first and second pressures, respectively, and said first pressure is appreciably higher than second pressure.

3. The system of claim 1 wherein said pump means includes an eductor pump.

4. The system of claim 3 wherein said closed loop liquid flow path includes a horizontal portion in which said eductor pump is disposed.

5. The system of claim 3 wherein said closed loop liquid flow path includes a vertical portion in which said eductor pump is disposed.

6. A well effluent heat treating system including a well effluent tank, a heat exchange fluid tank, heat exchange means including a closed loop liquid flow path having heat exchange means in each of said tanks, gas pressure operated pump means for pumping a heat exchange liquid through said flow path, gas burner means for said heat exchange fluid tank, well pressurized gas supply means, first gas delivery means operatively connecting said gas supply means to said pump through a thermostat valve operative to sense the need for heating said well effluent tank, a gas burner for heating said heat exchange fluid tank, second gas delivery means for supplying gas being discharged from said pump to said burner and including a gas operated control valve and third gas delivery means for delivering gas from said supply means to said control valve, said third gas delivery means including a thermostat operated valve responsive to a demand for heating said heat exchange fluid tank.

7. The system of claim 6 wherein said gas supply means comprises a gas outlet opening outwardly of said well effluent tank.

8. The system of claim 7 wherein said gas pressure operated pump means comprises an eductor pump.

9. The system of claim 8 wherein said eductor pump is horizontally disposed.

10. The system of claim 8 wherein said eductor pump is vertically disposed.

11. The method of treating well effluent including oil, water and gas supplied to a closed effluent tank including a gas outlet, said method including providing a heat transfer liquid tank and a closed heat transfer liquid loop flow path including heat exchange portions disposed within said effluent tank and heat transfer liquid tank, pumping a heat transfer liquid through said flow path responsive to a demand for heating said effluent tank and through the utilization of a gas pressure eductor pump serially connected into said flow path, separating the eductor pump gas discharge from the heat transfer liquid within said flow path and communicating said gas discharge with a burner means for heating said heat transfer liquid tank through a gas operated control valve to which gas is supplied from said gas discharge through a thermostat operative to sense a need for heating said heat transfer liquid tank.

* * * * *